US008507703B2

(12) United States Patent
Jalalpoor

(10) Patent No.: US 8,507,703 B2
(45) Date of Patent: Aug. 13, 2013

(54) PURIFICATION OF FATTY MATERIALS SUCH AS OILS

(75) Inventor: Massoud Jalalpoor, Schifferstadt (DE)

(73) Assignee: Grace GmbH & Co. KG., Worms (DE)

( * ) Notice: Subject to any disclaimer, the term of this patent is extended or adjusted under 35 U.S.C. 154(b) by 126 days.

(21) Appl. No.: 12/743,711

(22) PCT Filed: Nov. 27, 2008

(86) PCT No.: PCT/EP2008/010048

§ 371 (c)(1),
(2), (4) Date: Sep. 1, 2010

(87) PCT Pub. No.: WO2009/068277

PCT Pub. Date: Jun. 4, 2009

(65) Prior Publication Data

US 2010/0324317 A1 Dec. 23, 2010

Related U.S. Application Data

(60) Provisional application No. 61/004,353, filed on Nov. 27, 2007.

(51) Int. Cl.
*C11B 3/10* (2006.01)

(52) U.S. Cl.
USPC ..... 554/191

(58) Field of Classification Search
USPC ..... 554/191
See application file for complete search history.

(56) References Cited

U.S. PATENT DOCUMENTS

| | | | | | |
|---|---|---|---|---|---|
| 1,831,433 | A | * | 11/1931 | Zoul | 210/777 |
| 3,481,960 | A | * | 12/1969 | Hunnell et al. | 554/196 |
| 4,035,402 | A | * | 7/1977 | Levine | 554/200 |
| 4,049,686 | A | | 9/1977 | Ringers et al. | 260/424 |
| 4,276,227 | A | | 6/1981 | Kirby | 260/425 |
| 4,469,185 | A | | 9/1984 | Fox et al. | 172/540 |
| 4,734,226 | A | | 3/1988 | Parker et al. | 260/420 |
| 4,927,544 | A | | 5/1990 | van Opstal et al. | 210/712 |
| 4,939,115 | A | | 7/1990 | Parker et al. | 502/401 |
| 5,008,047 | A | | 4/1991 | Martens | 260/424 |
| 5,066,504 | A | | 11/1991 | Asbeck et al. | 426/417 |
| 5,069,829 | A | | 12/1991 | Van Dalen et al. | 260/428 |
| 5,079,208 | A | | 1/1992 | Lammers et al. | 502/238 |
| 5,231,201 | A | | 7/1993 | Welsh et al. | 554/191 |
| 5,239,096 | A | | 8/1993 | Rohdenburg et al. | 554/176 |
| 5,298,638 | A | | 3/1994 | Toeneboehn et al. | 554/191 |
| 5,336,794 | A | | 8/1994 | Pryor et al. | 554/206 |
| 5,626,756 | A | | 5/1997 | Heidlas et al. | 210/634 |
| 5,696,278 | A | | 12/1997 | Segers | 554/176 |
| 6,111,120 | A | | 8/2000 | Myers | 554/189 |
| 6,346,286 | B1 | | 2/2002 | Council et al. | 426/330.6 |
| 6,797,172 | B2 | | 9/2004 | Koseoglu et al. | 210/651 |

FOREIGN PATENT DOCUMENTS

| | | | |
|---|---|---|---|
| EP | 0349718 | | 6/1993 |
| FR | 2 460 996 | A * | 1/1981 |
| GB | 599595 | | 3/1948 |

* cited by examiner

*Primary Examiner* — Deborah D Carr
(74) *Attorney, Agent, or Firm* — William D. Bunch

(57) ABSTRACT

A purification system suitable for use in fatty material processing is disclosed. A method of using a purification system to process fatty materials, such as oils, edible oils, fats, and similar materials, is also disclosed.

19 Claims, 2 Drawing Sheets

PURIFICATION OF FATTY MATERIALS SUCH AS OILS

CROSS REFERENCE TO RELATED APPLICATION

This application is a continuation of U.S. Patent Application Ser. No. 61/004,353 filed Nov. 27, 2007.

FIELD OF THE INVENTION

The present invention is directed to a purification system useful for processing fatty materials such as oils, fats, and similar fatty materials including edible oils. The present invention is further directed to methods of using a purification system for processing fatty materials such as oils, fats, and similar fatty materials including edible oils.

BACKGROUND OF THE INVENTION

Known methods and systems for processing oils, such as edible oil, possess one or more inefficiencies that add costs and/or fail to maximize oil output. Typical inefficiencies of known methods and systems for processing oil include, but are not limited to, (i) one or more production bottlenecks within the process, (ii) frequent filter changes during a given oil process cycle, and (iii) inefficient use of filtration aids/absorbents, such as Perlite, diatomaceous earth, cellulose, clay, within the process.

There is a need in the art for more efficient and effective methods for cost-effectively processing fatty materials, such as oils, fats, and similar fatty materials including edible oils.

SUMMARY OF THE INVENTION

The present invention is directed to methods and systems for processing fatty materials such as oils, fats, and similar fatty materials, wherein the methods and systems eliminate one or more inefficiencies present in known methods and systems for processing fatty materials such as oils, fats, and similar fatty materials, such as methods and systems for producing edible oils. The methods and systems of the present invention utilize a purification system for processing fatty materials so as to (i) minimize potential production bottlenecks within the process, (ii) eliminate the need for filter changes and/or cleaning while processing the fatty material (e.g., oils, fats, and similar fatty materials including edible oil), (iii) efficiently utilize filtration aids/absorbents, within the process, (iv) use less nucleating agent within the process, which results in less fatty material losses and filtercake to be disposed of, or (v) any combination of (i) to (iv).

The present invention is directed to methods of processing a fatty material, such as edible oil, (or a fat or any similar material) using a purification system. In one exemplary embodiment according to the invention, the method of processing a fatty material using a purification system comprises the steps of mixing the fatty material (e.g., oil, fat, or similar fatty material) with a liquid nucleating agent; de-waxing the fatty material using the liquid nucleating agent; forming a heavy phase including the liquid nucleating agent and a light phase including the fatty material separating the heavy phase from the light phase. In one exemplary embodiment, this process eliminates the need for further de-waxing, such as dry de-waxing. In another exemplary embodiment, the method may further comprise a number of additional process steps typically used in known methods of processing oils (or fats or any other similar material). If further de-waxing is utilized (e.g., dry de-waxing), the wet de-waxing according to the invention reduces the amount of filter aid needed in the dry de-waxing process. In another embodiment, the liquid nucleating agent of the present invention may be utilized in combination with filter aids in a dry de-waxing process. Suitable additional process steps may include, but are not limited to, an impurity-removal step using silica particles, a drying step, a bleaching step, a fatty material (e.g., oil, fat, or similar fatty material) storing step, and a deodorizing step. The methods of the present invention are particularly useful in the production of edible oils.

In a further exemplary embodiment according to the invention, a composition comprises a heavy phase including a liquid nucleating agent and a light phase including a fatty material; wherein the liquid nucleating agent comprises wax. In this exemplary embodiment, the fatty material comprises less than about 50 ppm wax and/or the heavy phase comprises more than about 30% by weight wax based on the total weight of the dried heavy phase.

The present invention is further directed to an apparatus suitable for processing a fatty material (e.g., oil, fat, or similar fatty material). In one exemplary embodiment, the apparatus suitable for processing a fatty material (e.g., oil, fat, or similar fatty material) comprises, a mixing device that is suitable for mixing liquid nucleating agent and the fatty material; a cooling device in-line with the mixing device, cyrstalliser device that is suitable for nucleation/crystal growth/agglomeration in-line with cooling divice and a separating device in-line with the cyrstalliser device that is suitable for removing the liquid nucleating agent, wax and impurities from the fatty material. The exemplary apparatus may further comprise additional apparatus components typically found in oil processing apparatus. Suitable additional components include, but are not limited to, a mixing vessel suitable for bringing the fatty material (e.g., oil, fat, or similar fatty material) into contact with a plurality of silica particles so as to reduce an amount of impurities within the fatty material (e.g., oil, fat, or similar fatty material), a dryer, a fatty material (e.g., oil, fat, or similar fatty material) storage vessel, or any combination thereof.

These and other features and advantages of the present invention will become apparent after a review of the following detailed description of the disclosed embodiments and the appended claims.

DETAILED DESCRIPTION OF THE INVENTION

Figure 1:
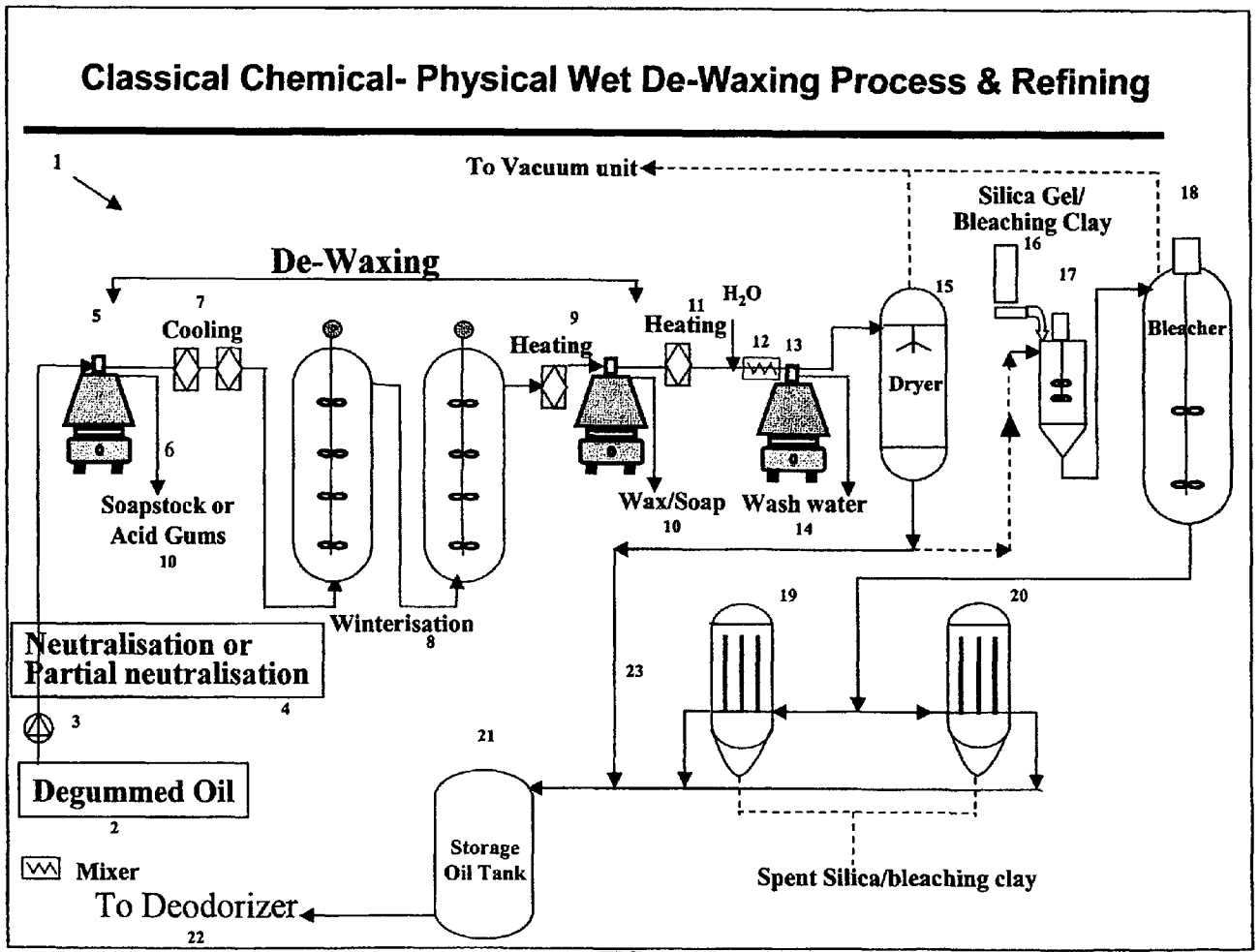
FIG. 1 depicts a schematic diagram of a conventional apparatus comprising a purification system suitable for processing a fatty material (e.g., oil, fat, or similar fatty material)

To promote an understanding of the principles of the present invention, descriptions of specific embodiments of the invention follow and specific language is used to describe the specific embodiments. It will nevertheless be understood that no limitation of the scope of the invention is intended by the use of specific language. Alterations, further modifications, and such further applications of the principles of the present invention discussed are contemplated as would normally occur to one ordinarily skilled in the art to which the invention pertains.

The present invention is directed to a purification system suitable for use in methods of processing fatty materials (e.g., oil, fat, or similar fatty material), such as edible oil. The present invention is further directed to methods of making fatty materials, such as edible oil, fats, or similar materials using a purification system. A description of exemplary methods of processing fatty materials (e.g., oil, fat, or similar fatty material) is provided below.

It must be noted that as used herein and in the appended claims, the singular forms "a", "and", and "the" include plural referents unless the context clearly dictates otherwise. Thus, for example, reference to "an oxide" includes a plurality of such oxides and reference to "oxide" includes reference to one or more oxides and equivalents thereof known to those skilled in the art, and so forth.

"About" modifying, for example, the quantity of an ingredient in a composition, concentrations, volumes, process temperatures, process times, recoveries or yields, flow rates, and like values, and ranges thereof, employed in describing the embodiments of the disclosure, refers to variation in the numerical quantity that can occur, for example, through typical measuring and handling procedures; through inadvertent error in these procedures; through differences in the ingredients used to carry out the methods; and like proximate considerations. The term "about" also encompasses amounts that differ due to aging of a formulation with a particular initial concentration or mixture, and amounts that differ due to mixing or processing a formulation with a particular initial concentration or mixture. Whether modified by the term "about" the claims appended hereto include equivalents to these quantities.

As used herein, the term "oil" is used to describe oils, fats, and triglycerides; oil-, fat- and triglyceride-containing fatty materials, as well as oil-, fat- and triglyceride precursor fatty materials that are convertible into oils, fats, triglycerides, edible oils, (e.g., triglycerides). Although the processes described herein are described in terms of oil processing so as to produce, for example, bleached oil, the disclosed process may be used to process other fatty materials including fats and similar materials.

As utilized herein, "chemical refining" is a neutralization process in which crude oil is treated with a caustic (normally NaOH) in excess to convert the free fatty acids present in the crude oil to soaps. These generated soaps, together with phosphatides, present in the crude oil are separated from oil followed by one or two washing steps.

As utilized herein, "acid degumming" is a degumming process in which crude oil is treated with a strong acid to decompose the non-hydratable phosphatides present in the crude oil and thereby liberate phosphatidic acid. This phosphatidic acid is then hydrated by the addition of water so that it can be separated from the degummed oil.

As used herein "acid refining" is a degumming process in which crude oil is treated with a strong degumming acid to decompose the non-hydratable phosphatides. This phosphatidic acid is then hydrated when said degumming acid is partially neutralized by the addition of a base so that it can be separated from the degummed oil.

As utilized herein, "crude oil" is the general name for a fatty material as isolated from its source and that has not undergone any treatment except perhaps a water degumming treatment ensuring that the crude oil meets trading specifications and does not throw a deposit during storage and transport. Crude oil therefore may contain free fatty acids and/or gums.

As used herein, "degumming" is the general term for the removal of phosphatides from a crude oil by washing it with an aqueous solution (water degumming), by treating it with an acid solution (acid degumming) followed by water washing, or treating it with an acid solution followed by partial neutralization (acid refining).

As used herein, "winterization" or "de-waxing" of edible oils is the separation of oils and the waxes with different melting points. Conventionally, oil is cooled for a time in order to allow the wax to crystallize and form solids, followed by separation the crystals or solids from the oil. The crystals or solids are removed by centrifugal separation (also known as "wet de-waxing") with subsequent cold filtration using filter aids, such as Perlite or diatomaceous earth (also known as "dry de-waxing"). Cold filtration is conducted subsequent to bleaching as shown in FIG. 1.

As defined herein, "waxes" are long chain fatty acid esters with long chain alcohols. These waxes crystallize at room temperature and cause "turbidity" in the refined oil.

As used herein, "wet oil de-waxing" is de-waxing performed prior to washing and drying/bleaching and is integrated directly in the chemical or physical refining processes by using centrifugal separation, as shown in FIG. 1.

As used herein, "dry oil de-waxing" is the de-waxing of oil under controlled conditions, with or without the addition of certain chemicals as wetting agents, by cold filtration using filter aids. Cold filtration is conducted subsequent to bleaching or after deodorisation.

As used herein, "fatty material" is defined as products derived from plant or animal material that consist mainly of organic molecules comprising fatty acid moieties.

As utilized herein, "FFA" is the standard abbreviation of Free Fatty Acids.

As used herein, "metal oxides" is defined as binary oxygen compounds where the metal is the cation and the oxide is the anion. The metals may also include metalloids. Metals include those elements on the left of the diagonal line drawn from boron to polonium on the periodic table. Metalloids or semi-metals include those elements that are on this line. Examples of metal oxides include silica, alumina, titania, zirconia, etc., and mixtures thereof.

As used herein, "liquid nucleating agent" is a material that is in a continuous liquid phase and that is capable of refining crude oil, including but not limited to, sols, colloids, suspensions, and the like, and mixtures thereof.

As used herein, "separating device" includes filters, centrifuges, decanters, clarifier and the like.

As utilized herein, "soapstock" is the by-product of the chemical neutralization of crude triglyceride oils. It comprises soaps, phosphatides and neutral oil besides many coloring compounds, particulate matter and other impurities as well as water containing various salts.

FIG. 1 depicts a conventional apparatus 1 for the physical or chemical de-waxing and refining of fatty material, such as edible oil. Degummed oil 2 is subjected to neutralization 4 by mixing the fatty material with an acid in a tank and subsequently mixed thoroughly (e.g., for about 2 to about 5 minutes). Then this mixture is combined with caustic with an in-line mixer. The neutralized oil is then fed into a centrifugal separator 5 to remove soapstock or acid gums 6. The oil may then be cooled using a cooling/chilled water system exchanger 7. Subsequently, the oil may be fed into one or more mixing tank(s) (e.g., crystallizers) 8 where it is mixed for a period of time suitable to form and grow wax particles in an aqueous phase (e.g., about 8 hours to about 24 hours below 10° C. with slow agitation). The mixture may optionally be heated using a heat exchanger and then sent to a second centrifuge 9 where the heavy phase 10 is separated from the oil. The heavy phase includes wax particles formed in the crystallization step. The non-aqueous phase containing the fatty material obtained from the centrifuge 9 may be heated using a heat exchanger 11 and washed with water using an in-line mixer 12 with subsequent separation using any conventional separator 13 (e.g., a centrifuge) to further purify the fatty material. Subsequent to the centrifuge(s), the oil may be sent to a dryer 15 and then combined with an adsorbent 16, such as a silica gel (e.g., TriSyl® available from Grace GmbH & Co. KG) or bleaching clay in a mixing tank 17. The mixture may then be sent to a bleacher 18 to remove impurities (e.g., phospholipids, associated trace elements such as Ca, Mg and Fe, and soap) from the oil, followed by separation of the adsorbent/bleaching clay from the oil using filters 19 and 20. The oil is then optionally stored in a holding tank 21 and/or subjected to deoderization 22 to remove free fatty acids. This conventional refining process utilizes both wet de-waxing and dry de-waxing to obtain low wax amounts (about 10 ppm) in the final refined oil. However, dry de-waxing significantly increases refining costs, since such process requires 1 kg of filter aid/ton of oil for removal of each 100 ppm of waxes. This conventional technique decreases the refining yield.

The present invention is directed to an apparatus suitable for processing a fatty material (e.g., oil, fat, or similar fatty material), such as oil, so as to produce a filtered fatty material having fewer impurities when compared to the pre-processed fatty material. The apparatus of the present invention are particularly useful in the production of edible oils. In one exemplary embodiment, the apparatus suitable for processing a fatty material (e.g., oil, fat, or similar fatty material) comprises a mixing device that is suitable for mixing liquid nucleating agent and the fatty material; a crystallizing device in-line with the mixing device that is suitable for providing wax particles; and a separating device in-line with the cooling device that is suitable for removing the liquid nucleating agent from the fatty material. The crystallizing device preferably provides for nucleation, crystal growth and agglomeration of the wax particles. The crystallizing device may also include a cooling device. The apparatus of the present invention may further comprise a number of additional apparatus components typically found in fatty material (e.g., oil, fat, or similar fatty material) processing apparatus including, but are not limited to, a mixing vessel suitable for bringing the fatty material (e.g., oil, fat, or similar fatty material) into contact with a plurality of silica particles so as to reduce an amount of impurities within the fatty material, a dryer, a fatty material (e.g., oil, fat, or similar fatty material) storage vessel, one or more flow valves, and process control equipment. One exemplary apparatus of the present invention is shown in FIG. 2.

The present invention eliminates the dry de-waxing step in conventional de-waxing processes, where filter aids are used to remove the wax impurities via filtration. In the present process, the use of liquid nucleating agent in the wet de-waxing step reduces the wax content of the fatty matter to less than 100 ppm, preferably less than 80 ppm, more preferably less than 60 ppm, and even more preferably less than 50 ppm. This eliminates the need for further dry de-waxing later in the refining process and reduces fatty material loss that accompanies dry de-waxing processes. In another exemplary embodiment, the method may further comprise a number of additional process steps typically used in known methods of processing oils (or fats or any other similar material). If further de-waxing is utilized (e.g., dry de-waxing), the wet de-waxing according to the invention reduces the amount of filter aids needed in the dry de-waxing process. In another embodiment, the liquid nucleating agent of the present invention may be utilized in combination with filter aids, in a dry de-waxing process.

In one embodiment of the invention, a fatty material is provided that does not need further purification, for instance because previous separation steps (e.g., physical or chemical refining) have left some impurities in the fatty material. Because the above-mentioned wet de-waxing step may not completely remove all of the impurities in the fatty material, further purification steps, such as a subsequent water washing as disclosed in U.S. Pat. No. 4,698,185 or a two-centrifuge process with recycling as disclosed in EP 0 349 718, may be performed. Instead of using these further conventional purification steps as mentioned above, a process according to the invention may be used to remove residual phosphatides from the degummed triglyceride oil (e.g., the acid degummed or acid refined oil). Accordingly, the oil leaving the centrifugal separator used to remove the waxes from the acid refined or chemically neutralized oil may be treated according to a process of the invention by mixing it with additional aqueous liquid nucleating agent. After the de-waxing process, the temperature may be increased in the range of 80° C. to 100° C., but the use of lower temperatures is also within the scope of the present invention.

Figure 2:
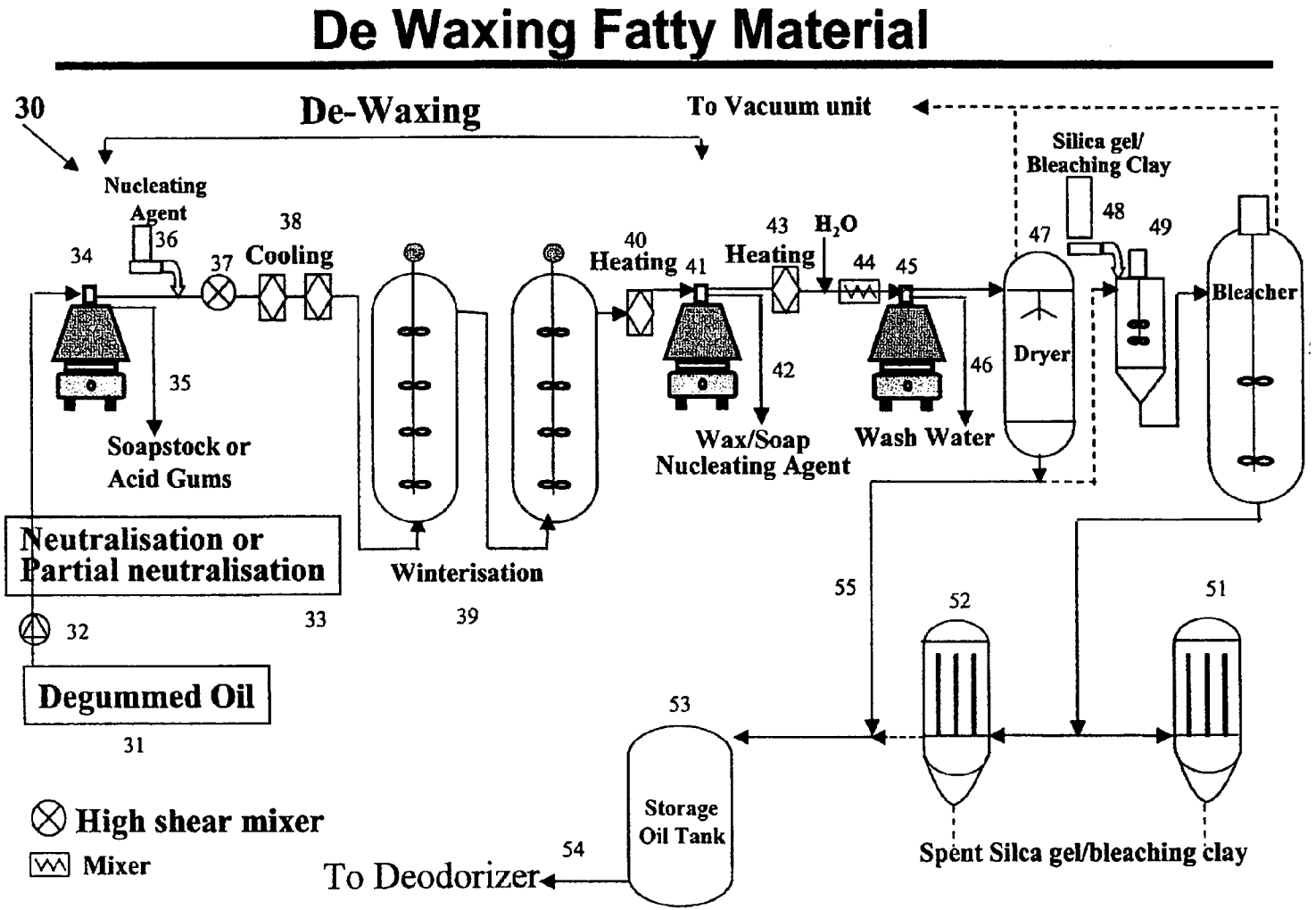
FIG. 2 depicts a schematic diagram of an exemplary apparatus comprising a purification system suitable for processing a fatty material (e.g., oil, fat, or similar fatty material) according to the present invention.

FIG. 2 depicts an apparatus 30 according to the present invention for the physical or chemical refining and de-waxing of fatty material, such as edible oil. Degummed oil 31 is subjected to neutralization 33 by mixing the fatty material with an acid in a tank and subsequently mixed thoroughly (e.g., for about 2 to about 5 minutes). Then this mixture is combined with caustic with an in-line mixer. The neutralized oil is then fed into a centrifugal separator 34 to remove soapstock or acid gums 35. The oil may then be combined with liquid nucleating agent 36, and optionally water (not shown), using an in-line mixer 37 and then cooled using a cooling/chilled water system exchanger 38. Subsequently, the oil may be fed into one or more mixing tank(s) 39 (e.g., tank crystallizers, scraped surface crystallizers, or drum crystallizers, such as those set forth in U.S. Pat. Nos. 5,066,504; 4,276,227; and 4,035,402; the entire subject matter of which is incorporated herein by reference) where it is slowly mixed for a period of time suitable to allow the nucleating agent form and grow wax particles in an aqueous phase (e.g., about 8 hours to about 24 hours below 10° C. with slow agitation). Subsequently, the mixture may optionally be heated using a heat exchanger 40 and then sent to a second centrifuge 41 where the heavy phase 42 is separated from the oil. The heavy phase includes the liquid nucleating agent comprising wax and impurities. The non-aqueous phase containing the fatty material obtained from the centrifuge 41 may be heated using a heat exchanger 43 and washed with water using an in-line mixer 44 with subsequent separation using any conventional separator 45 (e.g., a centrifuge) to further purify the fatty material. Subsequent to the centrifuge(s), the oil may be sent to a dryer 47 and sent directly to tank 53 via line 55 without any additional treatment. Optionally, the fatty material may be combined with an adsorbent 48, such as a silica gel (e.g., TriSyl® available from Grace GmbH & Co. KG) or bleaching clay in a mixing tank 49. The mixture may then be sent to a bleacher 50 to remove further impurities, such as those that affect the color of the fatty material (e.g., phospholipids, associated trace elements such as Ca, Mg and Fe, and soap) from the oil, followed by separation of the clay or gel from the oil using filters 51 and 52. The oil is then optionally stored in a holding tank 53 and/or subjected to deoderization 54 to remove free fatty acids.

It should be noted that exemplary apparatus 30 shown in FIG. 2 is only one possible apparatus containing a purification system, and various configuration changes are possible in any given apparatus. For example, although not shown in exemplary apparatus 30, apparatus of the present invention could comprise more than one separating device to remove the liquid nucleating agent, each of which are positioned within a purification system as shown in exemplary apparatus 30 of FIG. 2. It should be noted that the present invention is directed to any apparatus that comprises the purification system as described herein.

Although not shown in FIG. 2 exemplary apparatus 30 may further comprise process control equipment capable of opening and closing one or more flow valves within the apparatus so as to route the fatty material (e.g., oil, fat, or similar fatty material) along a different pathway through the purification system from one process flow step to a subsequent process flow step. Other process control equipment (not shown) may be used to provide a number of process control functions including, but not limited to, in-line, real-time monitoring of one or more fatty material streams (e.g., a contaminant concentration in a given fatty material stream, a temperature of a fatty material stream, a color of a fatty material stream, etc.) in one or more locations throughout a given apparatus; monitoring of pressure build-up in one or more locations throughout a given apparatus; measuring fatty material flow rates in one or more locations throughout a given apparatus; activating and turning off one or more pumps; providing automatic shut-down in case of an apparatus malfunction (e.g., a leak or excessively higher than normal pressure); etc.

Various liquid nucleating agents may be utilized in the present invention, such as, sols or colloids of metal oxides, etc., and derivatives or mixtures thereof. Preferably, the liquid nucleating agents include sols or colloids of metal oxides, such as for example, colloidal silica, colloidal alumina, colloidal zirconia, colloidal titania, etc. or mixtures thereof. Such materials may have a variety of particle sizes, shapes, distributions, porosity, solid content concentrations, surface coating, counter-ions, etc. There exists in a number of different commercially available grades and the particles may have a negative charge and a positive counter ion such as a sodium or ammonium cation or may have a positive charge when the stabiliser counter ion is a negative anion such as for example a chloride anion. If the fatty material that is to be treated in accordance with the process of the invention contains free fatty acids, these acids must be prevented from interfering with the removal of the impurities. Accordingly a liquid nucleating agent that is negatively charged and therefore repels the free fatty acids is preferably used.

Liquid nucleating agent may be in the form of a suspension in water and the solids content of such suspensions generally varies between 25% and 50% by weight. Liquid nucleating agent may be prepared by any method well known from the person skilled in the art. For cost reasons, the amount of liquid nucleating agent to be mixed with the fatty material of the invention is preferably kept as low as possible. In practice, the amounts of liquid nucleating agent used fall within the range of about 0.1 to about 10.0% by weight, preferably from about 0.2 to about 5.0% by weight, more preferably from about 0.3 to about 1.0% by weight, and even more preferably from about 0.4 to 0.6% by weight based on the total weight of the fatty material.

Water may optionally be added with the liquid nucleating agent or thereafter, which serves the purpose of diluting the liquid nucleating agent so that it can be more readily separated from the fatty material, or second phase, to form the first phase of the process according to the invention. If water is present, its amount is not critical. Typically, an adequate amount of water may be less than about 5% by weight, preferably less than about 3% by weight, and more preferably less than about 2% by weight of the fatty material being treated. More than 5% by weight water may be utilized but it increases the amount of wastewater to be treated and/or disposed of, and consequently the purification cost as a whole.

For the effective removal of waxes and impurities according to the present invention, a minimum contact time between the liquid nucleating agent and the fatty material is preferred. This time is not critical and may range from about 8 hours to about 24 hours, depending on the temperature of the fatty material. Longer crystallization times may be required if the temperatures are below 10° C.

For separation of the aqueous phase comprising the liquid nucleating agent in accordance with the present invention, a centrifugal separator is preferably used. Consequently, retrofitting existing de-waxing and neutralization lines to enable them to operate the process according to the invention is often quite simple and straightforward. The centrifugal separator used to wash the degummed or neutralized oil can then be used for the removal of the liquid nucleating agent. The amount of fatty material removed during this process is quite low, typically less than about 2% by weight, preferably less than about 1% by weight, more preferably less than about 0.8% by weight, and even more preferably less than about 0.7% by weight based upon the total weight of the fatty material.

Moreover, such existing lines can also operate an embodiment of the process according to the invention in which the liquid nucleating agent is added to the oil stream before it enters the first centrifugal separator. In these embodiments, the spent liquid nucleating agent forms part of the stream of waxes (de-waxing), gums (degumming) or soaps (neutralization) respectively so that no separate filter aid stream has to be handled. Moreover, the oil has already been exposed to some liquid nucleating agent so that somewhat less fresh liquid nucleating agent has to be added according to the invention to obtain the same final results.

Prior to de-waxing according to the present invention, the wax content in the fatty material may comprise less than or equal to about 0.5% by weight wax. After de-waxing, the amount of wax in the fatty material (i.e., light phase) is less than or equal to about 100 ppm, preferably, less than or equal to about 80 ppm, more preferably, less than or equal to about 50 ppm, and even more preferably, less than or equal to about 30 ppm. The heavy phase may comprise at least about 30% by weight, preferably, at least about 40% by weight, more preferably, at least about 50% by weight wax, and even more preferably, at least about 60% by weight wax based on the total weight of the dried solids in the heavy phase. The treated fatty material obtained in the light phase contains small amounts of impurities. For example, the residual phosphorus content may be less than about 20 ppm, preferably less about 10 ppm, more preferably less than about 8 ppm, and even more preferably less than about 6 ppm. The amount of soaps present in the fatty material of the light phase may be less than about 100 ppm, preferably less than about 80 ppm, more preferably less than about 60 ppm, and even more preferably less than about 50 ppm.

The present invention is further directed to methods of processing a fatty material (e.g., oil, fat, or similar fatty material) using a purification system such as in exemplary apparatus shown in FIG. 2. In one exemplary embodiment according to the invention, the method of processing fatty material using a purification system comprises the steps of mixing the fatty material (e.g., oil, fat, or similar fatty material) with liquid nucleating agent; de-waxing the fatty material using the liquid nucleating agent; forming a heavy phase including the liquid nucleating agent and a light phase including the fatty material; and separating the heavy phase from the light phase. The de-waxing process may comprise cooling of the fatty material using a heat exchanger to about 10° C. followed by crystallization of wax particles in a crystallizer for 2 to 24 hours. The nucleating agent of the present invention acts as nuclei to accelerate the formation of wax crystals to form, grow into larger particles, and then agglomerate into even larger particles. The agglomerated particles possess a much higher density than the fatty material and are, thus, much more readily separated from the fatty material using conventional separators (e.g., centrifugal separators). The advantage of the process according to the present invention relates to the significant reduction of wax to very low levels (e.g., less than 50 ppm) without the need for post dry de-waxing.

In a further exemplary embodiment according to the invention, the a fatty material composition comprises a heavy phase including a liquid nucleating agent and a light phase including the fatty material (e.g., oil, fat, or similar material); wherein the liquid nucleating agent comprises wax and may also comprise other impurities. In this exemplary embodiment, the fatty material in the light phase may comprise less than or equal to about 100 ppm, preferably, less than or equal to about 80 ppm, more preferably, less than or equal to about 50 ppm, and even more preferably, less than or equal to about 30 ppm wax. The wax in the heavy phase may comprise at least about 30% by weight, preferably, at least about 40% by weight, more preferably, at least about 50% by weight wax, and even more preferably, at least about 60% by weight wax based on the total weight of the dried solids in the heavy phase. The liquid nucleating agent may comprise metal oxide sols described herein, but is preferably, silica sol.

In this exemplary embodiment, the method may further comprise a number of additional process steps typically used in known methods of processing fatty materials (e.g., oils, fats, or similar fatty materials). Suitable additional process steps may include, but are not limited to, a fatty material drying step (e.g., a volatiles removal step), an impurity-removal step using silica particles, a bleaching step, a fatty material storing step, and a deodorizing step.

The methods of processing a fatty material may further comprise a number of additional steps including, but not limited to, any number of process control steps to monitor the quality and/or color of the fatty material, such as an oil, during the process, as well as monitor other process parameters (e.g., pressure, temperature, etc.), adjusting flow valves to alter flow path of fatty material through the staggered filter system, starting/stopping one or more pumps to adjust fatty material flow through the staggered filter system, separating adsorbent particles disposed on an inlet surface of one or more filters in the system, disposing of adsorbent particles.

The present invention is even further directed to fatty materials produced by the above-described methods of the present invention. Suitable fatty materials that may be produced using the above-described methods include, but are not limited to, oils, bleached oils, fats, edible oils, and similar materials.

EXAMPLES

The present invention is further illustrated by the following examples, which are not to be construed in any way as imposing limitations upon the scope thereof. On the contrary, it is to be clearly understood that resort may be had to various other embodiments, modifications, and equivalents thereof which, after reading the description herein, may suggest themselves to those skilled in the art without departing from the spirit of the present invention and/or the scope of the appended claims.

Examples 1-4

A 2 liter sample of enzymatically degummed sunflower oil was ordered from Cereol Mannheim and subsequently heated in a tank to 50° C. Under agitation (i.e., magnetic stirring), 0.1% ammonia (25%) is added and the agitation and heating are continued for another 20 minutes. The oil is then cooled to 10° C. and treated with different types of colloidal silicas, LUDOX® PX30 silica (Example 1), LUDOX® PW30 silica (Example 2), LUDOX® PW50 silica (Example 3), and LUDOX® PT40 silica (Example 4), all available from Grace GmbH & Co. KG. Each colloidal silica is added at different concentrations (0.1%, 0.3% and 0.6%) to 100 gram samples of the oil and agitated slowly for 2.5 hours at 10° C. The 12 samples are then centrifuged at 2300 RPM in a J2-21 WE centrifuge, available from Beckman Coulter, Inc., in order to separate the heavy phase from the light phase, which comprises the treated oil samples. After decantation, the treated oil samples are dried at 70° C. under vacuum for 15 minutes. The colloidal silica treated oil samples and an untreated oil sample are then maintained at −5° C. for 24 hours. None of the colloidal silica treated oil samples developed any haze or wax formation, while the untreated oil sample showed slight hazing, which indicates that wax is removed from the oil as a result of the colloidal silica treatment.

Examples 5-8

A 2 liter sample of enzymatically degummed sunflower oil was ordered from Cereol Mannheim. The oil is then without any treatment with caustic cooled directly to 10° C. and treated with different types of colloidal silicas, LUDOX® PX30 silica (Example 5), LUDOX® PW30 silica (Example 6), LUDOX® PW50 silica (Example 7), and LUDOX® PT40 silica (Example 8), all available from Grace GmbH & Co. KG. Each colloidal silica is added at different concentrations (0.1%, 0.3% and 0.6%) to 100 gram samples of the oil and agitated slowly for 2.5 hours at 10° C. The 12 samples are then centrifuged, in order to separate the heavy phase from the light phase, which comprises the treated oil samples. After decantation, the treated oil samples are dried at 70° C. under vacuum for 15 minutes. The colloidal silica treated oil samples and an untreated oil sample are then maintained at −5° C. for 24 hours. None of the colloidal silica treated oil samples developed any haze or wax formation, while the untreated oil sample showed slight hazing, which indicates that wax is removed from the oil as a result of the colloidal silica treatment.

While the invention has been described with a limited number of embodiments, these specific embodiments are not intended to limit the scope of the invention as otherwise described and claimed herein. It may be evident to those of ordinary skill in the art upon review of the exemplary embodiments herein that further modifications, equivalents, and variations are possible. All parts and percentages in the examples, as well as in the remainder of the specification, are by weight unless otherwise specified. Further, any range of numbers recited in the specification or claims, such as that representing a particular set of properties, units of measure, conditions, physical states or percentages, is intended to literally incorporate expressly herein by reference or otherwise, any number falling within such range, including any subset of numbers within any range so recited. For example, whenever a numerical range with a lower limit, $R_L$, and an upper limit $R_U$, is disclosed, any number R falling within the range is specifically disclosed. In particular, the following numbers R within the range are specifically disclosed: $R=R_L+k(R_U-R_L)$, where k is a variable ranging from 1% to 100% with a 1% increment, e.g., k is 1%, 2%, 3%, 4%, 5% . . . 50%, 51%, 52% . . . 95%, 96%, 97%, 98%, 99%, or 100%. Moreover, any numerical range represented by any two values of R, as calculated above is also specifically disclosed. Any modifications of the invention, in addition to those shown and described herein, will become apparent to those skilled in the art from the foregoing description and accompanying drawings. Such modifications are intended to fall within the scope of the appended claims.

What is claimed is:

1. A method of processing a fatty material using a purification system, said method comprising the steps of:

(a) mixing the fatty material with a liquid nucleating agent comprising a sol;

(b) de-waxing the fatty material using the liquid nucleating agent;

(c) forming a heavy phase including the liquid nucleating agent and a light phase including the fatty material; and (d) separating the heavy phase from the light phase.

2. A process according to claim 1, wherein said fatty material comprises triglyceride oil.

3. A process according to claim 1, wherein said liquid nucleating agent comprises metal oxide sols.

4. A process according to claim 1, wherein said liquid nucleating agent comprises silica sols.

5. A process according to claim 1, wherein said liquid nucleating agent is added in an amount of 0.2 to 1.0% by weight of fatty material.

6. A process according to claim 1, wherein said de-waxing step comprises, cooling the fatty material and liquid nucleating agent and mixing the fatty material and liquid nucleating agent for a time sufficient to form particles of wax and nucleating agent.

7. A process according to claim 1, wherein said separating step comprises centrifugal separation.

8. A process according to claim 1, wherein the removal of the heavy phase from the light phase employs a centrifugal separator.

9. A process according to claim 1, the fatty material in the light phase comprises less than or equal to about 50 ppm wax.

10. A process according to claim 1, wherein the process does not include dry de-waxing or includes a reduced amount of filter aid used in dry de-waxing.

11. A process according to claim 1, wherein the removal process results in less than about 2% by weight of fatty material loss.

12. A process according to claim 1, wherein the process further comprises dry de-waxing using the nucleating agent.

13. A fatty material composition comprising;

(a) a heavy phase including a liquid nucleating agent comprising a sol; and (b) a light phase including said fatty material;

(c) wherein the heavy phase further comprises wax.

14. A fatty material composition according to claim 13, wherein said liquid nucleating agent is present in an amount of less than about 2% by weight based on the weight of the composition.

15. A fatty material composition according to claim 13, wherein the fatty material in the light phase contains less than 50 ppm of wax.

16. A fatty material composition according to claim 13, wherein the fatty material in the light phase contains less than 40 ppm of wax.

17. A fatty material composition according to claim 13, wherein said liquid nucleating agent comprises metal oxide sols.

18. A fatty material composition according to claim 13, wherein said liquid nucleating agent comprises silica sols.

19. A fatty material composition according to claim 13, wherein said fatty material comprises triglyceride oil.

* * * * *